US005738218A

United States Patent [19]

Gonzales

[11] Patent Number: 5,738,218

[45] Date of Patent: Apr. 14, 1998

[54] FOLDABLE PROTECTIVE PACKAGING

[76] Inventor: Juanita A. Gonzales, 490 Cambridge Ave., Palo Alto, Calif. 94306

[21] Appl. No.: 741,092

[22] Filed: Oct. 30, 1996

[51] Int. Cl.[6] ..... B65D 85/30

[52] U.S. Cl. ..... 206/583; 206/478; 206/589; 206/594; 29/115

[58] Field of Search ..... 206/521, 477–479, 206/483, 495, 583, 588–592, 784, 418, 419, 594, 305, 320; 229/104, 115

[56] References Cited

U.S. PATENT DOCUMENTS

| | | | |
|---|---|---|---|
| 804,151 | 11/1905 | Miner | 229/104 |
| 1,021,998 | 4/1912 | Myers | 206/589 |
| 1,352,759 | 9/1920 | Markert | 206/589 |
| 1,367,174 | 2/1921 | Botnen | 206/589 |
| 2,771,184 | 11/1956 | Ryno et al. . | |
| 3,355,011 | 11/1967 | Cilluffo | 229/104 |
| 3,752,301 | 8/1973 | Bluemel . | |
| 5,121,838 | 6/1992 | Dickie | 206/589 |
| 5,325,967 | 7/1994 | Gonzales . | |
| 5,425,499 | 6/1995 | Pfieffer | 229/115 |

*Primary Examiner*—B. Dayoan
*Assistant Examiner*—Luan K. Bui
*Attorney, Agent, or Firm*—Morrison & Foerster LLP

[57] ABSTRACT

This is a container for the protection of an object during shipping. It is foldable (preferably from a single sheet) and forms a platform for supporting the object, which platform is separated from the exterior wall of the container by the use of at least one spacer panel attached to the edge of the support platform. The object is held firmly against the support platform in such a way that it too is spaced away from the container wall. Although the disclosed container may have open ends, it desirably has ends completing the enclosure that also fold from the beginning sheet.

9 Claims, 9 Drawing Sheets

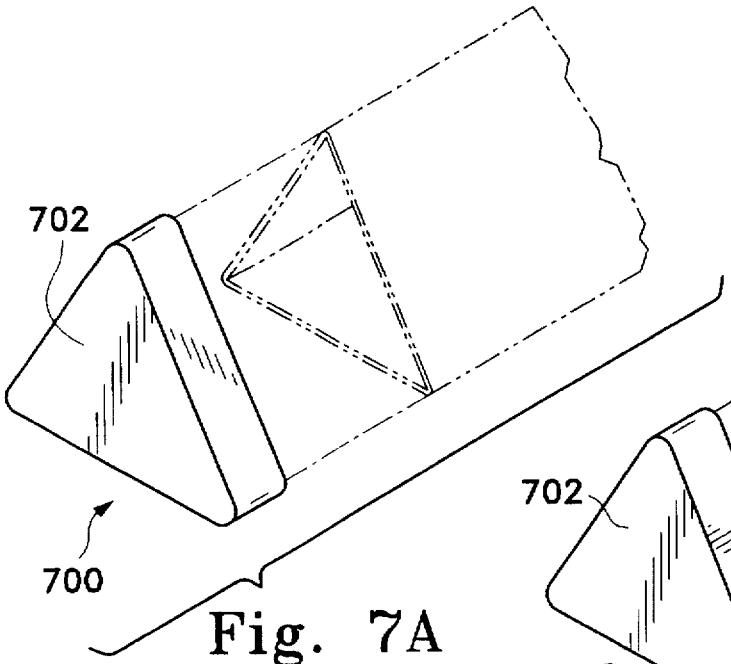
Fig. 7A
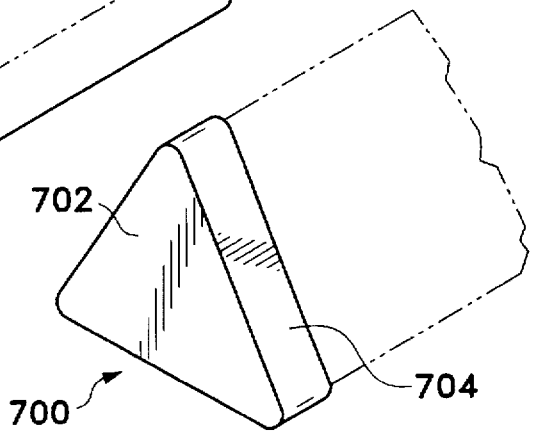
Fig. 7B
Fig. 8A
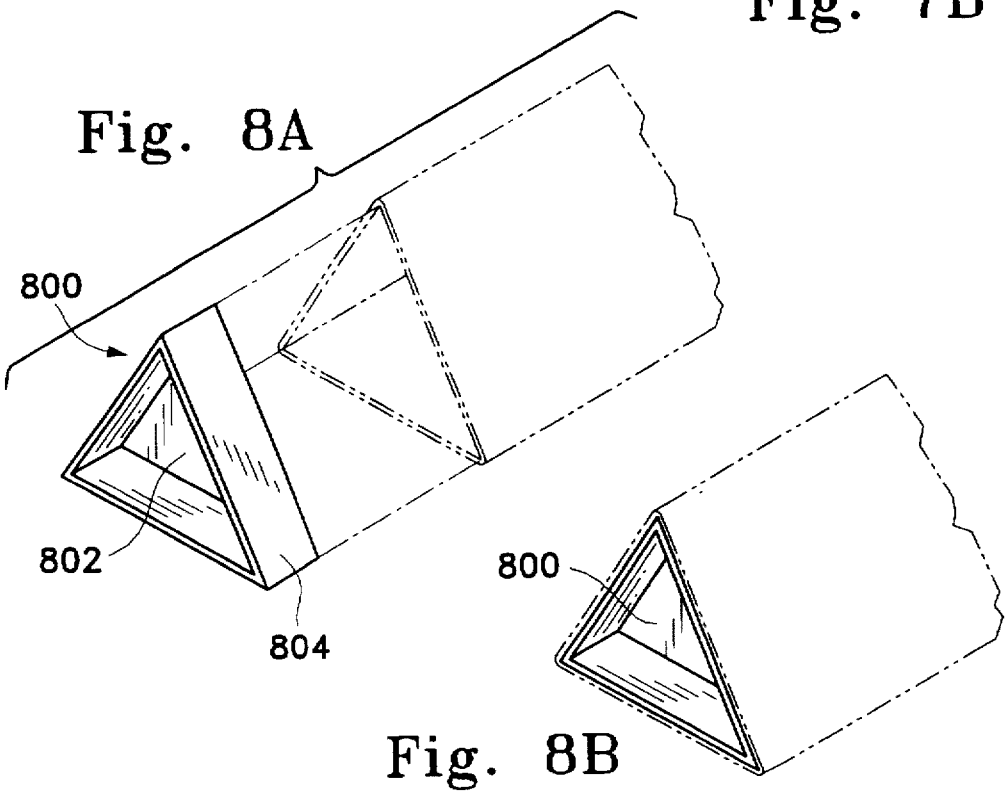
Fig. 8B

FOLDABLE PROTECTIVE PACKAGING

FIELD OF THE INVENTION

This invention is a container for the protection of an object during shipping. It is foldable (preferably from a single sheet) and forms a platform for supporting the object, which platform is separated from the exterior wall of the container by the use of at least one spacer panel attached to the edge of the support platform. The object is positioned with respect to the support platform in such a way that it too is spaced away from the container wall. The object may be held firmly against the support platform although it may also be positioned in an open portion of the platform. Although the inventive container may have open ends, it desirably has ends completing the enclosure that also fold from the beginning sheet.

BACKGROUND OF THE INVENTION

Packaging of small articles for shipping often relies on the use of a simple rectangular box filled with various types of filler materials such as well known Styrofoam "peanuts," popcorn, foam rubber, expanded starch packing material, etc. Each of these packing materials, however, is unhandy in that they create debris which preferably is recycled but often is not. Storage of the packing material prior to use consumes storage space. Most shipping costs are based on weight and, although the weight of most of the noted packing materials is quite small, there seems little reason to pay for it.

This invention deals with a foldable device which secures the object to be shipped to an internal platform situated within the exterior walls of the shipping container. The inventive packaging is constructed in such a way that filler protective material is not needed nor desired. The object to be shipped is attached in some fashion to a support platform within the outer walls of the shipping container. The platform and object are both separated from the exterior walls by some discrete distance. There are a number of patents showing containers which maintain the object to be protected away from the walls of the container during shipping.

For instance, U.S. Pat. No. 2,771,184 to Ryno et al. shows a cylindrical package in which the object to be protected is suspended between the two ends of a cylinder by a twisted plastic tube. The plastic tube is twisted tied above and below the article and held in tension in the center of the tube during shipping.

U.S. Pat. No. 3,752,301, to Bluemel, shows a shock-proof packing container having a rectagonal outer carton and a polygonal inner support member. The polygonal support member is configured in such a way that it fits snugly inside the outer carton and in turn supports a flexible sling. The articles to be shipped are wrapped in the sling and are suspended in the interior both of polygonal inner member and the rectangular outer box.

My earlier patent, U.S. Pat. No. 5,325,967, issued on Jul. 5, 1994, shows a packaging device also formed of an outside container and having a removable inner platform which, via the use of folded and integrated spacers, causes the object to be protected to be spaced apart from the walls of the container. The object to be shipped is held against the inner platform by, for instance, a plastic bag which envelops the object and that bag passes through an orifice within the support platform and is attached in some fashion to the edge of that platform.

My earlier patent further discusses other variations of protective packaging found in the prior art at column one.

None of the devices shown or described in any of these prior art documents shows a device having the structure and features of my inventive container.

SUMMARY OF THE INVENTION

This invention is a foldable protective container suitable for shipping objects. It preferably is of a paper cardboard, e.g., corrugate, although it may be of any suitable flat material such as paper bonded styrofoam board or polyolefin flat stock materials simulating paper corrugate or the like. The inventive packaging has three integral components: the support platform for holding the goods to be protected, a spacer flap which shares an edge with the protective platform, and three or more protective outer walls which form the outer surface of the overall package. Preferably, these three components are situated on a single sheet in such a way that the container may be merely rolled into a triangular shape. A square or rectangular cross-section is also suitable but is less preferred because of the additional flat stock required.

The support platform additionally utilizes one or more of a variety of different ways of holding the object to be protected against the support platform. The additional component is typically polymeric in nature and preferably is elastomeric. In this way, the object to be protected is placed underneath a polymeric sheet or placed within a bag or other similar binding devices to hold the object against the platform. The platform may utilize one or more orifices to provide a site to keep the device to be protected against the platform. The orifice or orifices to may also be used to carry the object within the open orifice.

Finally, the ends of the device may be either—and preferably—integral with the beginning sheet and simply folded into place as needed or the ends may be independent components which are plugged into or capped onto the open ends.

BRIEF DESCRIPTION OF THE DRAWINGS

FIGS. 7A and 7B show front quarter views of caps suitable for placement on the ends of a container such as shown in FIG. 1C.

FIGS. 8A and 8B show front quarter views of caps suitable for placement within the ends of a container such as shown in FIG. 1C.

DESCRIPTION OF THE INVENTION

This invention relates to foldable protective packaging. As mentioned elsewhere, the packaging has an initial form-desirably, a single flat sheet-which may be folded into a structure having a set of outer containing walls forming a protective volume in a support platform for holding the object to be protected away from those containing walls. One or more spacer panels (or spacer flaps) are attached to the support platform and are used to space that support platform away from the exterior walls. The inventive packaging may be used with an assortment of independent end closures and methods of holding the protected cargo or object immobile against the support platform.

For purposes of clarity herein, the description of the invention is separated into several sections: the container and support platform assembly; the various ends suitable for closing the ends of the overall container structure; and variations on structures to hold the protected object against the support platform.

Each of these sections may be used independently, in combination, in assembling a complete protective packaging device.

Container and Support Platform

Figure 1A:
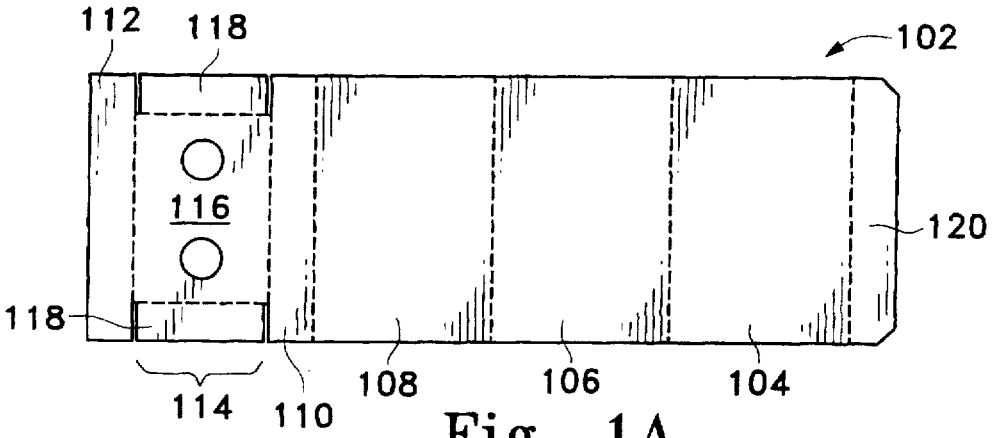
FIG. 1A shows a plan view of the unfolded sheet making up one simple variation of the inventive container.
Figure 1B:
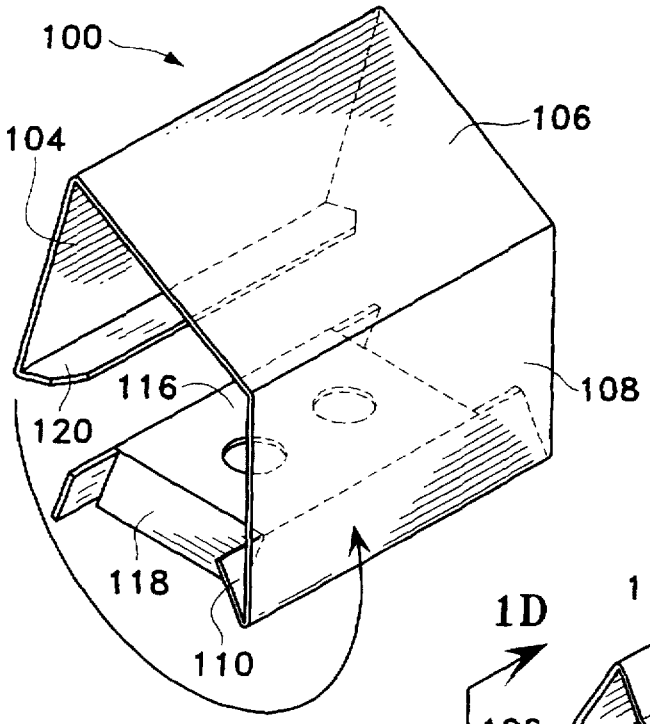
FIG. 1B depicts the way in which the flat sheet shown in FIG. 1A is folded into the inventive container.
Figure 1D:
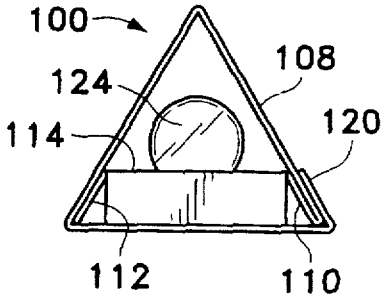
FIG. 1D is an end view of the container shown in FIG. 1C.
Figure 1C:
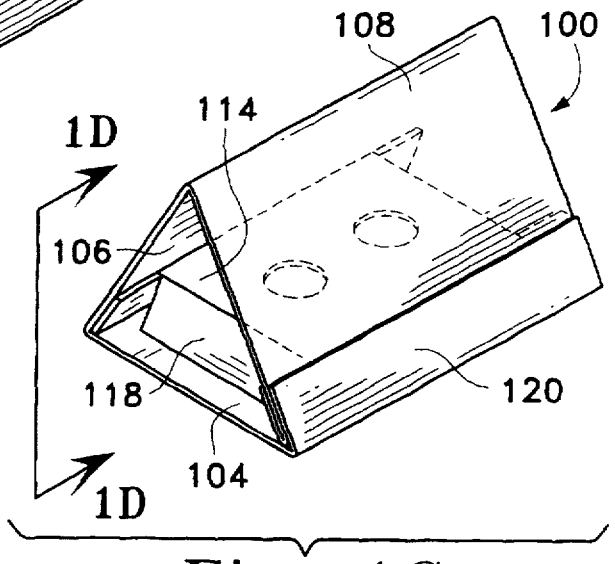
FIG. 1C shows a front quarter view of the inventive container as folded.

FIGS. 1A through 1D show a first variation (100) of the folded inventive assembly. FIG. 1A shows a flat sheet (102) which folds as is shown in FIG. 1C into the folded container assembly (100) shown in FIGS. 1C and 1D.

FIG. 1A, in particular, shows a flat sheet (102) having three exterior container walls (104), (106) and (108) with a foldable seam between each adjoining set of container walls (104), (106), (108). The FIG. 1A variation (100) includes a pair of spacer panels (110), (112), and a support platform (114) having a region or field (116) away from the support platform's (114) edges upon which to place the object to be supported. Various ways of supporting such an object are discussed and shown below. Closure ends are also similarly shown below.

In this variation of the invention, a pair of support tabs (118) is provided. The sheet (102) finally may include an assembly panel (120) which is used as a surface to provide the folded structure (100) with rigidity. As will be discussed below in conjunction with another variation of this invention, assembly panel (120) is optional. Assembly panel (120) may be spread with a water-based glue, an adhesive, or some type of mechanical attachment component such as VELCRO, or may be simply used as a surface for staples or the like. The method of adhesion of the assembly panel (120) to the rest of the structure is not particularly critical to this invention.

FIG. 1B simply shows the way in which the inventive assembly is folded. The creases adjoining the two spacer panels (118) and (120) are folded in such a way that the resulting support platform (116) is pushed towards the center of the resulting structure. Exterior container walls (108), (106), and (104) are then folded around support panel (116) in such a way that spacer panel (120) is adjacent exterior panel (106) and spacer panel (118) is adjacent exterior panel (106). Assembly panel (120) is wrapped all the way around until it can be placed flat against exterior panel (108). As may be seen better in FIG. 1C, support tabs (118) are folded towards exterior panel (104) so to provide a measure of rigidity to resulting support platform (114). Again, assembly panel (120) may be glued or stapled or otherwise made adherent to exterior panel (108).

FIG. 1D shows an end view of this variation (100) of the invention. The object to be protected (124) is shown generically nestling against the support platform (114). It should be apparent that when assembly flap (120) is sealed against exterior container wall (108), the overall structure is a determinate structure. The spacer flaps (110) and (112) support surface (114) and the object to be protected (124) away from the exterior walls of the container.

As noted above, the material making up these devices may be any appropriate, and preferably recyclable, sheet stock. Most corrugate is made from kraft paper or other similar paper stock. Of course, depending on the service into which the packaging is placed, other materials may be selected, e.g., polyethylene terephthalate (Mylar), polyethylene sheet, polypropylene (clear or fibrous paper product), or the like are acceptable. The sheet stock may be corrugate or may, of course, have a honeycomb core. The way in which the edges are creased and then sealed are obviously dependent upon the material from which the packaging is made. For instance, a corrugate or honeycomb flat stock may be simply creased or partially scored. Thermoplastic polymeric materials such as fibrous polypropylene or Mylar may be provided with seams by the use of heat.

FIGS. 2A through 2C, 3A through 3C and 4A through 4C show slightly simplified versions of the inventive triangular protective packaging.

Figure 2A:
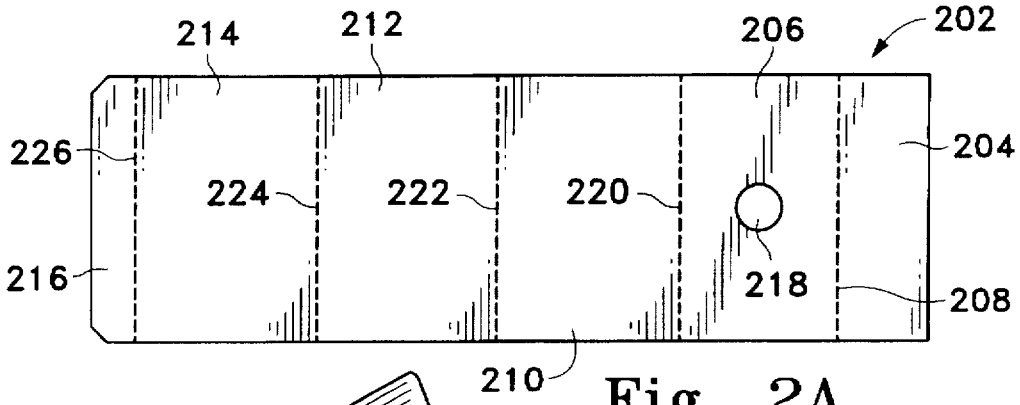
FIG. 2A shows a plan view of a second variation of the inventive container.
Figure 2B:
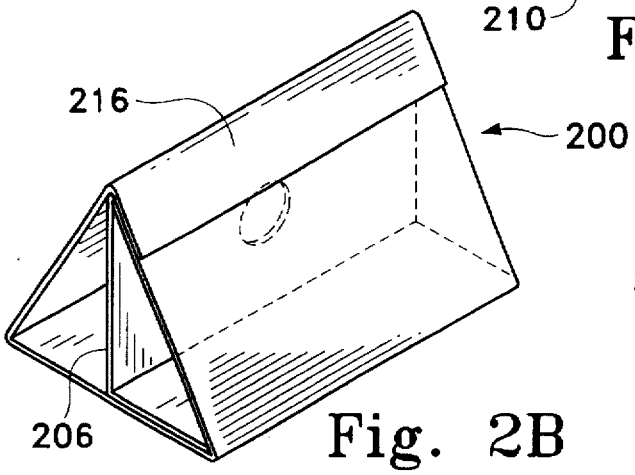
FIG. 2B shows the folded container resulting from the folding of the FIG. 2A sheet.

The FIG. 2A variation (as folded (200) in FIG. 2B) is also made up of a single sheet (202). This variation is somewhat simpler than the device shown in FIGS. 1A through 1D in that only a single spacer panel (204) is used. It adjoins support panel (206) via a seam (208). Exterior panels (210), (212) and (214) are similar to their analogous brethren shown in FIG. 1A. An assembly panel (216) similar to the assembly panel (112) in FIG. 1A is also provided. Support platform (206) is shown with a single orifice (218), the function of which will be discussed below. This variation (202) is additionally somewhat simpler than the variation (102) found in FIGS. 1A through 1D because each of the folds variously at (208), (220), (222), (224), and (226) is assembled by folding it in the same direction. That is to say that once the object to be protected is placed on support platform (206), the sheet (202) is simply "rolled" into a form shown in FIGS. 2B and 2C with support platform (206) generally bisecting the angle formed at the apex of the triangular container near the sealing flap or assembly panel (216). In this variation of the invention, it is sometimes advisable to place an adhesive on the surface of spacer panel (204) where it adjoins the interior surface of exterior wall (212) to prevent shifting of support platform (206) towards the interior of exterior wall (214), although such adhesive or other attachment mechanisms may not be necessary. In this variation, it is thought to be a benefit to the overall structure.

Figure 2C:
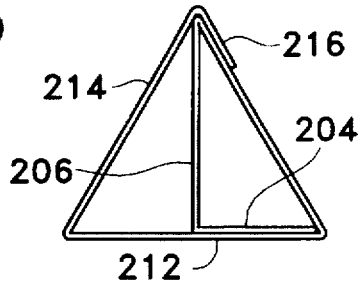
FIG. 2C is an end view of the inventive device of FIGS. 2A and 2B.
Figure 3A:
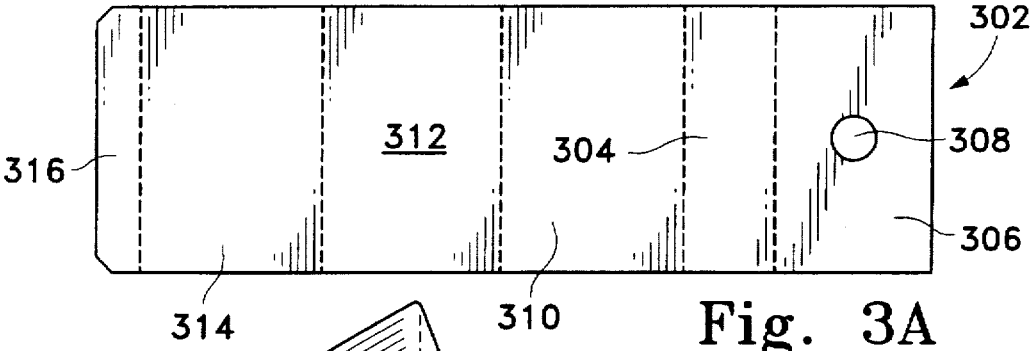
FIG. 3A shows a plan view of another variation of the unfolded sheet making up one simple variation of the inventive container.
Figure 3B:
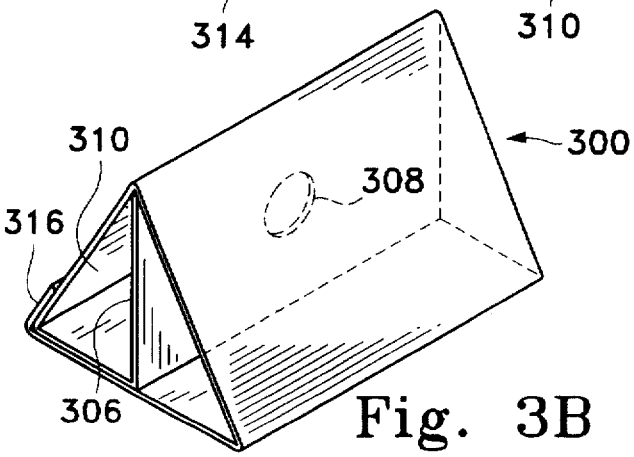
FIG. 3B shows a front quarter view of the variation of the device found in FIG. 3A.
Figure 3C:
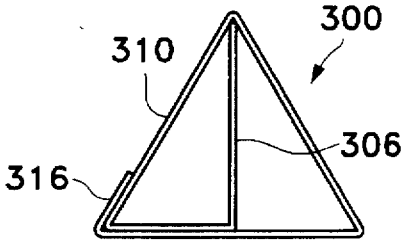
FIG. 3C is an end view of the inventive device shown in FIG. 3A.

FIGS. 3A through 3C show still another variation (300) in which, again, as was the case with the variation shown in FIGS. 2A through 2C, only a single spacer panel is needed. In this variation, the support platform (306) is found at the end of the foldable sheet (302). Again, a single orifice (308) is shown as a site for locating the object to be protected during shipping. Three exterior panels, (310), (312), and (314), are used in the same way as the exterior panels were described in relation to the figures above. This variation is highly desirable because as folded and shown in FIGS. 3B and 3C, support platform (306) has no tendency to shift after assembly. Consequently, no additional adhesives or fasteners are even suggested to maintain the integrity of the finally assembled protective packaging variation (300). The depicted assembly flap (316) must be fastened in some manner to the exterior container wall (310) so to provide rigidity to the structure.

Figure 4A:
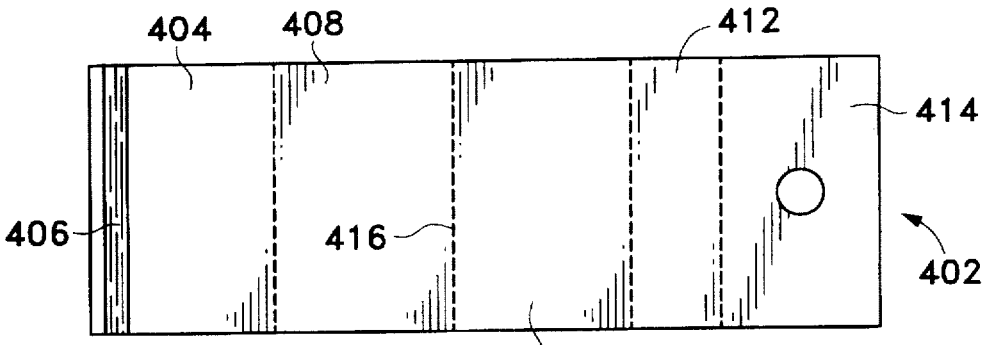
FIG. 4A shows a plan view of the unfolded sheet of a further variation of invention.
Figure 4B:
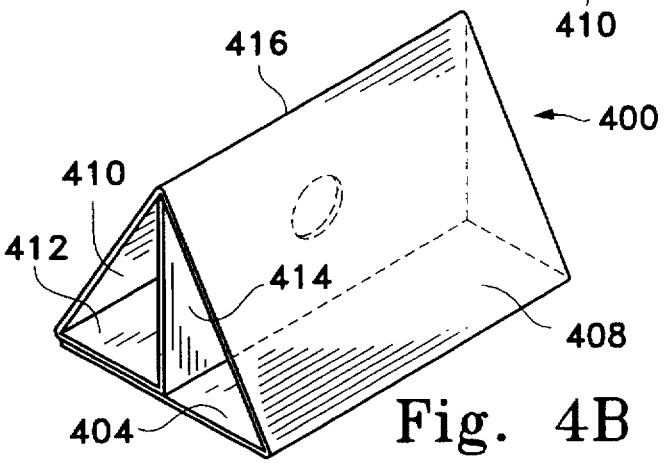
FIG. 4B shows a front quarter view of the folded container shown in FIG. 4A.
Figure 4C:
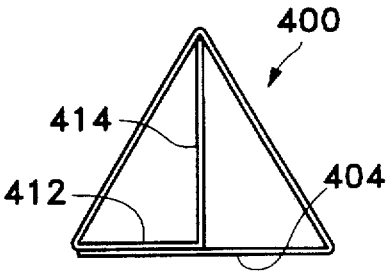
FIG. 4C shows an end view of the variation shown in FIGS. 4A and 4B.

FIGS. 4A through 4C show a slight variation of the device shown in FIGS. 3A through 3C. In this variation (400), the assembly flap, e.g., (316) in FIG. 3A, has been eliminated. In this simple variation, exterior wall (404) may be provided with an adhesive strip (406) and placed in such a way that it will adhere to spacer panel (412). As was the case with the variation (300) shown in FIGS. 3A through 3B, once this variation (400) is assembled, there is no tendency for any of the component sheets to creep from their assembled position. It should be apparent to those reading that other fasteners such as staples or the like may be used in place of adhesive strip (406) to cause exterior container wall (404) to adhere to spacer panel (412). The free end of support platform (414) is held in place in a folded crease (416) between exterior container walls (408) and (410).

FIGS. 5A to 5C and 6A to 6C show additional variations of the invention in which the overall cross-section of the inventive protective container is square or rectangular rather than triangular as has been the case with the figures discussed above.

Figure 5A:
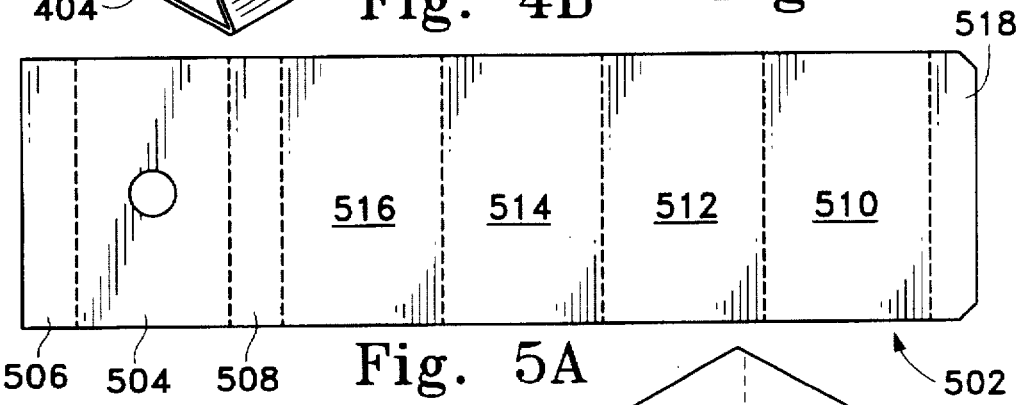
FIG. 5A shows a plan view of the unfolded sheet of a rectangular variation of the invention.
Figure 5B:
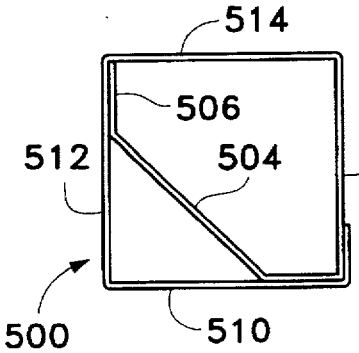
FIG. 5B shows a front quarter view of the folded container shown in FIG. 5A.
Figure 5C:
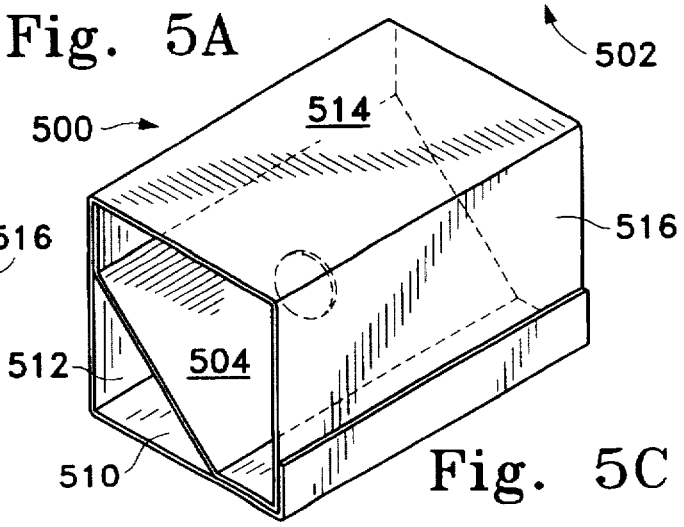
FIG. 5C shows an end view of the variation shown in FIGS. 5A and 5B.

FIG. 5A shows a plan view of a variation shown as folded box (500) in FIGS. 5B and 5C. This variation of the invention includes a support platform (504) and a pair of spacer panels (506) and (508). They are spaced in such a way that the support panel as shown in the folded configuration in FIGS. 5B and 5C is spaced away from each of exterior container walls (510) and (512). The support platform (504) is situated so that it provides a maximum of interior volume between the face of support platform (504) and the interior surfaces of exterior container walls (514) and (516). In this variation (500), the container may be constructed without need for ends to enclose the volume within the box. For instance, this may be done by being sure that spacer panel (506), spacer panel (508) and assembly panel (518) adhere, respectively, to the interior surface of exterior container wall (512), exterior container wall (510), and the exterior surface of exterior container wall (516). This forms a triangular portion of the box between support platform (504) and exterior walls (512) and (510). This triangular cross-section box portion is a determinate structure and will provide a great deal of rigidity to the overall structure (500). It may be desirable in certain circumstances, however, to provide some sort of a capping or insert device at the ends of support platform (504) to close the structure.

Again, this device is one which is simply made in that it may be folded beginning with spacer panel (506) and simply "rolled" into a shape which has a substantial amount of rigidity once the proper adhesion points are provided.

Figure 6A:
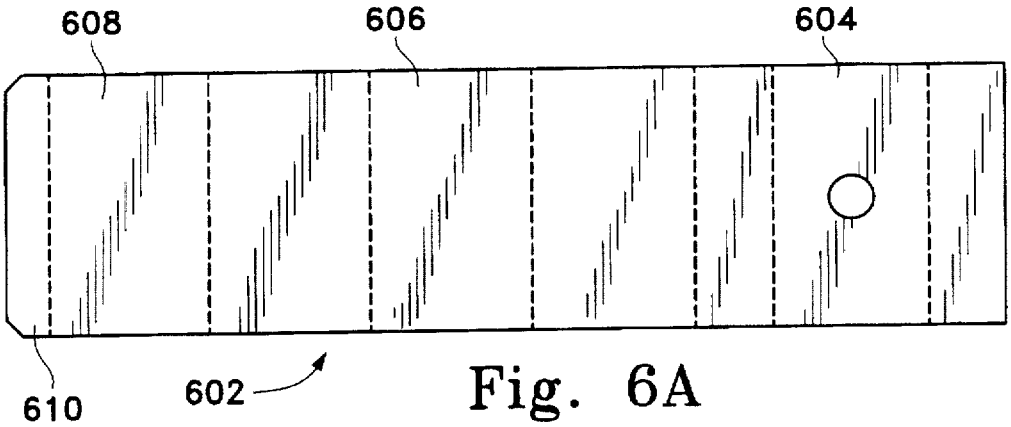
FIG. 6A shows a plan view of the unfolded sheet of a rectangular variation of the invention.
Figure 6C:
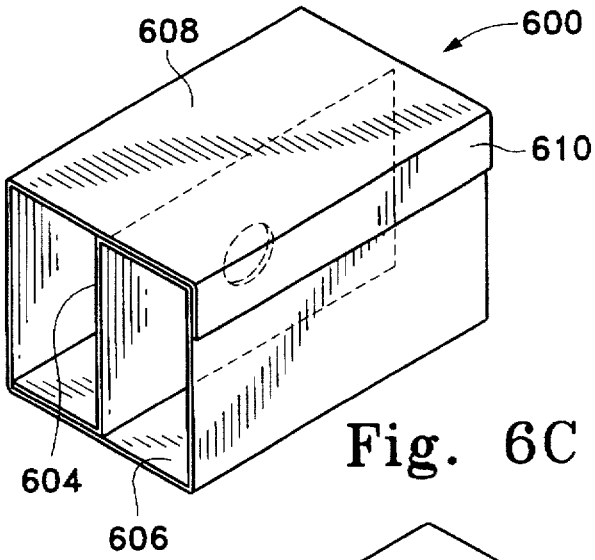
FIG. 6C shows an end view of the variation shown in FIGS. 6A and 6B.
Figure 6B:
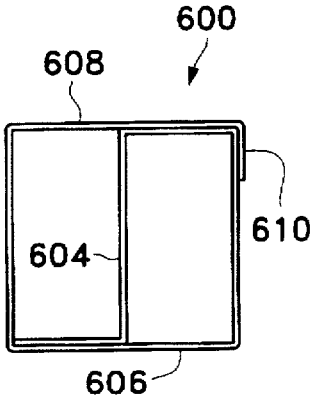
FIG. 6B shows a front quarter view of the folded container shown in FIG. 6A.
Figure 6D:
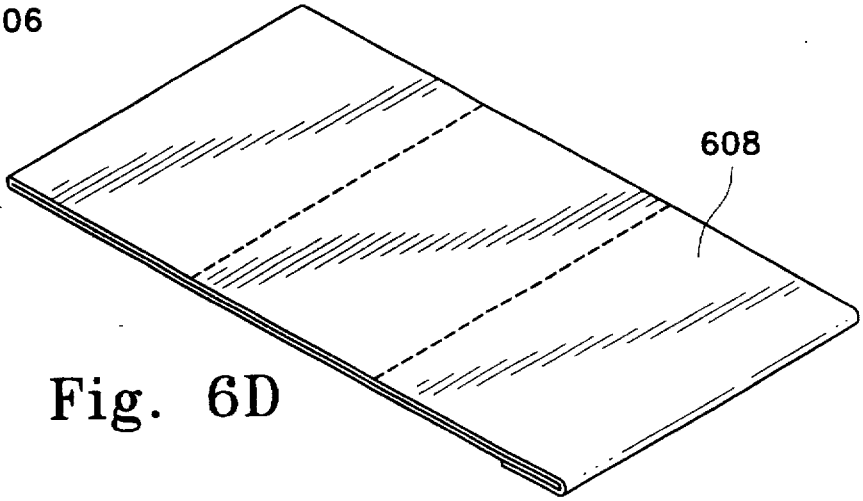
FIG. 6D shows a front quarter view of the folded container shown in FIG. 6A after it has been collapsed.

FIG. 6A is still another variation of the inventive device ((600) as folded in FIGS. 6B and 6C). It too uses a sheet of flat stock creased in appropriate places. As may be noted in FIGS. 6B and 6C, the support platform (604) passes from the interior side of an exterior wall (606) to some point on the interior surface of exterior container wall (608). This structure has the benefit that since it is not determinate, it may be simply folded over and preassembled using assembly flap (610) into the shape shown in FIG. 6D. Again, this structure is not determinate in nature and consequently could use a pair of ends of some type to provide it with some rigidity. Nevertheless, the support platform (604) provides a region in its center which is spaced apart from each of the exterior walls when assembled as shown in FIGS. 6B and 6C.

End Assemblies

As noted above, the manner in which the ends of this shipping protection assembly is closed is not particularly critical to the concept of this invention. However, FIGS. 7A, 7B, 8A, 8B, 10A, 10B, and 11A–11D show various suitable capping assemblies for the structure of this invention.

FIGS. 7A and 7B show a simple cap having an end component (702) and three side walls (704). The cap is sized in such a fashion that it fits on the outside of the foldable protective packaging shown, e.g., in FIGS. 1A through 4C. The outer cap (700) may be stapled or glued or otherwise made to adhere to the remainder of the assembly.

Similarly, FIGS. 8A and 8B show similarly constructed end cap (800) also having an end piece (802) and side walls (804). However, instead of fitting on the exterior of one of the prismatic shaped variations of the inventive protective packaging shown in FIGS. 1A through 4C, end assembly (800) fits into the interior space of the inventive construction. End assembly (800) may be glued or stapled in place. Other discrete devices may be used to be independently placed on the exterior or interior of the prismatic or rectangular structures discussed above.

Figure 9A:
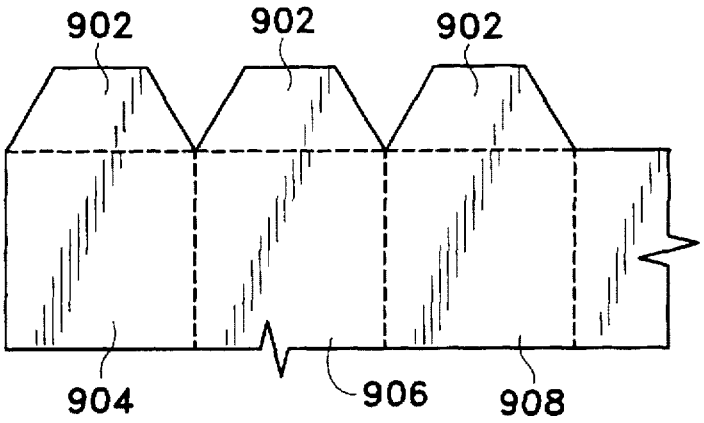
FIG. 9A shows a partial plan view of the unfolded sheet of end flaps for the inventive container.
Figure 9B:
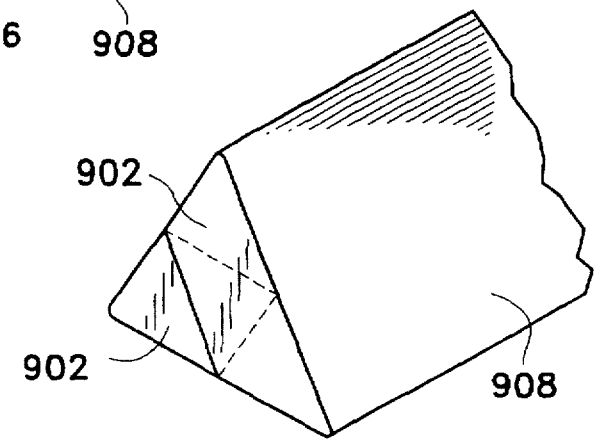
FIG. 9B shows a front quarter view of the folded end flaps as shown in FIG. 9A.

FIGS. 9A mad 9B show an integral set of end panels which are placed on the side of exterior container walls (904), (906) and (908). When folded into the prismatic configuration shown in FIG. 9B, end leaves (904) may be interleaved to form a closed end.

Figure 10A:
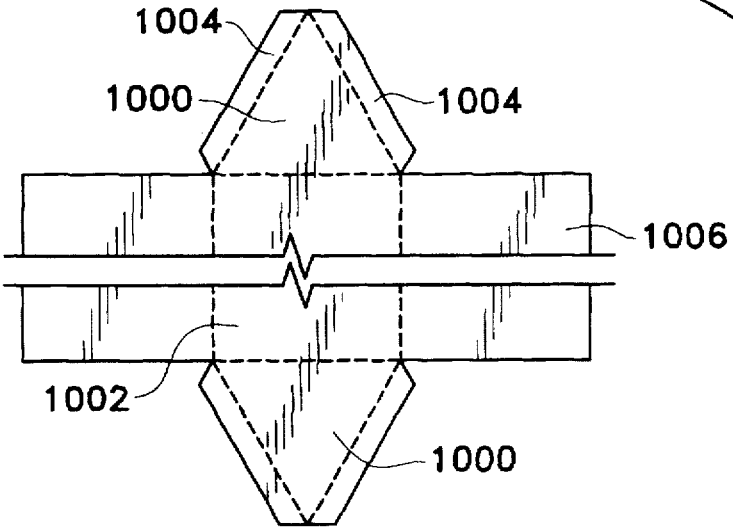
FIG. 10A shows a partial plan view of the unfolded sheet of end flaps for the inventive container.
Figure 10B:
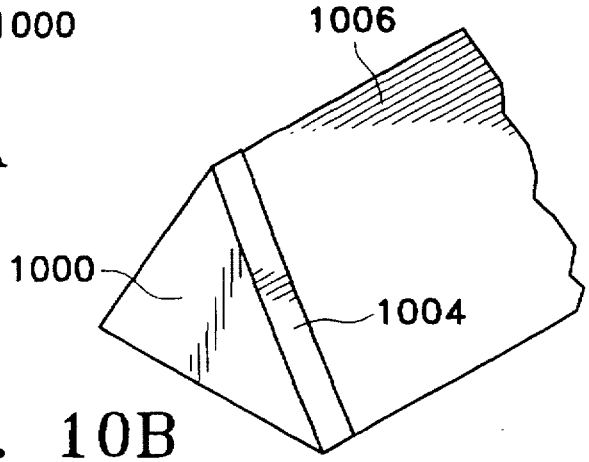
FIG. 10B shows a front quarter view of the folded end flaps as shown in FIG. 10A.

Another simple end-closing assembly may be seen in FIG. 10A. In this variation, a pair of triangular field flaps (1000) are attached via a folding seam to an exterior container wall (1002). Assembly or glue flaps (1004) are provided on triangular end cap (1000). When folded as shown in FIG. 10B, the assembly flaps (1004) simply overlap onto the adjacent exterior container walls (1006)

A final, somewhat more elegant solution to providing a readily used end assembly is found in FIGS. 11A through 11D. In this variation, only a single end assembly is shown for clarity of explanation.

Figure 11A:
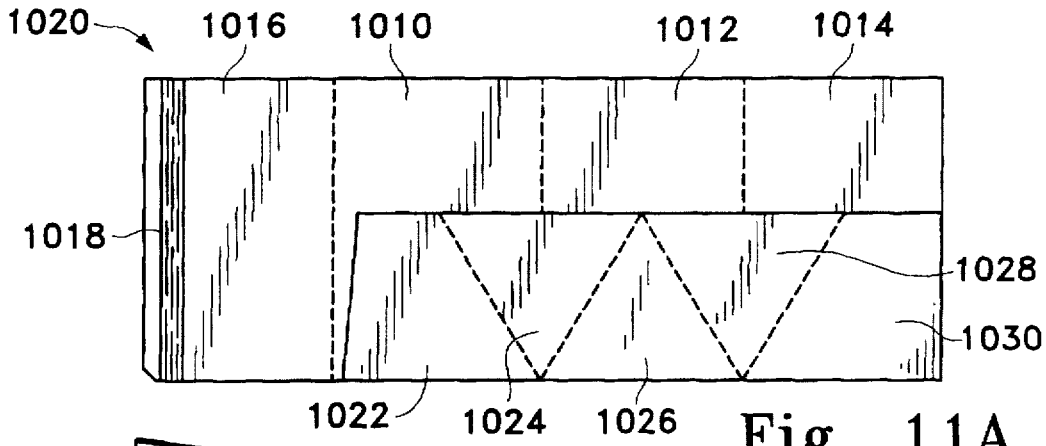
FIG. 11A shows a partial plan view of the unfolded sheet of an end construction for the inventive container.

The partial protective packaging assembly shown incorporates three exterior container walls (1010), (1012), and (1014). Assembly flap (1016) with an adhesive strip (1018) is also shown for illustration. In the lower part of FIG. 11A is shown end flap assembly (1020) which is made up of five panels (1022), (1024), (1026), (1028), and (1030). The flap assembly (1020) may be made by simply folding up a lower edge of the three exterior container walls (1020), ( 1012), and ( 1014) to provide the noted flap assembly (1020). A "W"-shaped crease is provided in flap assembly (1020). This permits region (1020) and ( 1030) to be glued to their respective exterior container walls ( 1010), ( 1014). Fields (1024), (1026), and (1028) are free to move as the assembly is folded.

Figure 11B:
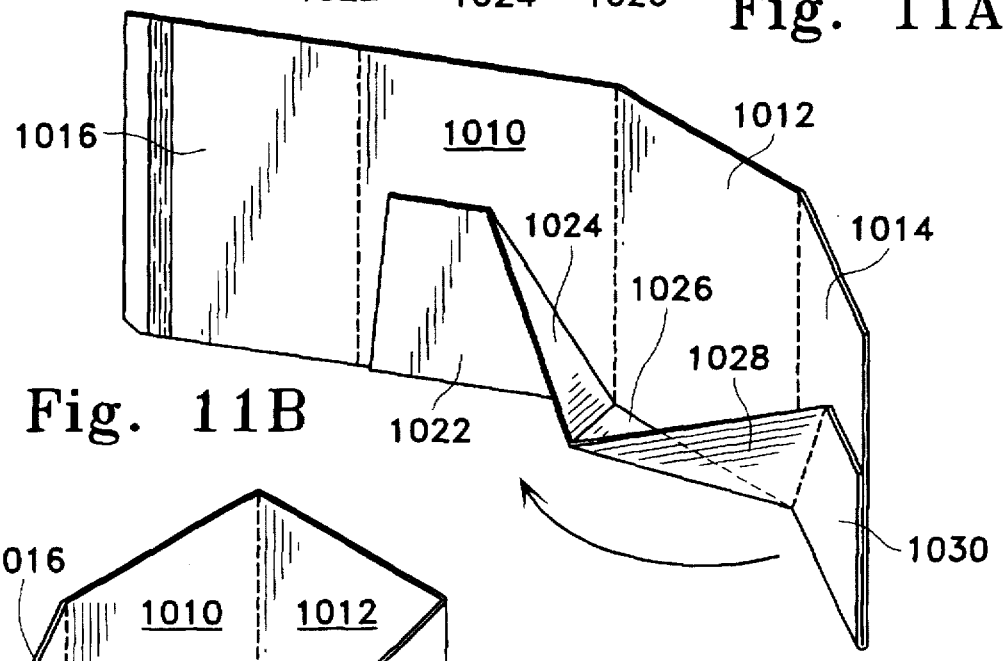
FIGS. 11B and 11C show the steps of folding the FIG. 11A structure.
Figure 11C:
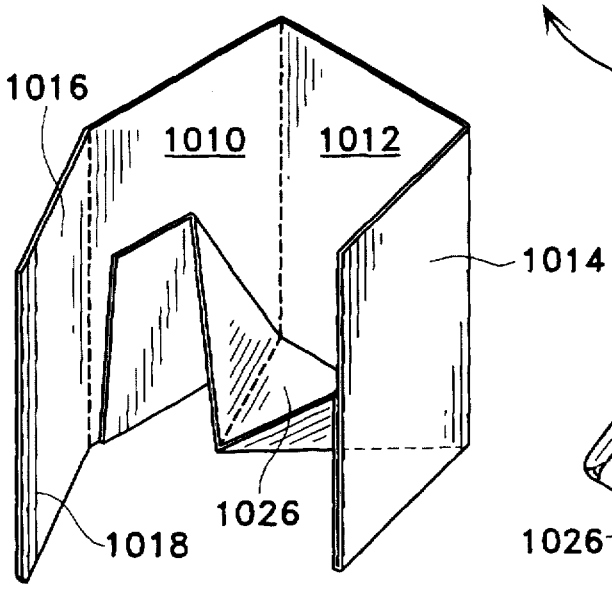
Figure 11D:
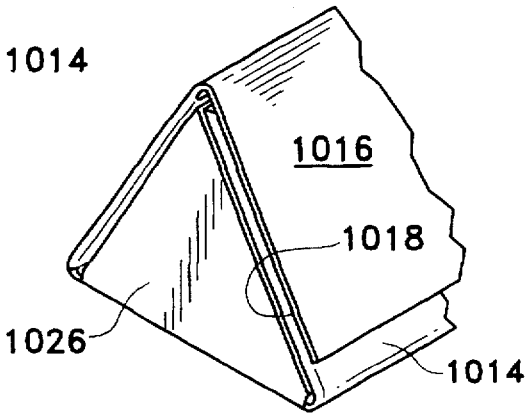
FIG. 11D shows a reverse view of the folded end construction for the inventive container made according to FIG. 11A.

FIG. 11B shows the beginning of the steps needed to fold the device into a configuration having a single end cap (1026). As the sheet is folded, field (1022) and field (1030) may be seen remaining in place. FIG. 11C shows a further step in that folding. Finally, FIG. 11D shows (from a reverse view of the FIG. 11C perspective) the finally folded end assembly with field (1026) in place and construction flap (1018) overlying exterior container wall (1014) to cover the end of the assembly.

Other variations, both integral with the disclosed structure or added independently to the end of the structure, should also be apparent from these teachings.

Adjunct Structures for Holding the Protected Object

There are a variety of ways to hold or to position the objects to be protected with respect to the protective structures described herein. Several of the most useful are described and shown in FIGS. 12, 13A–13B, and 14A–14B. In each instance, the bag or sheet used to retain the object in place on the support platform is independent of the form of the structure found on the exterior surface. Each of the designs shown in these figures is independently suitable for any of the exterior forms of the inventive foldable protective packaging discussed above.

Figure 12:
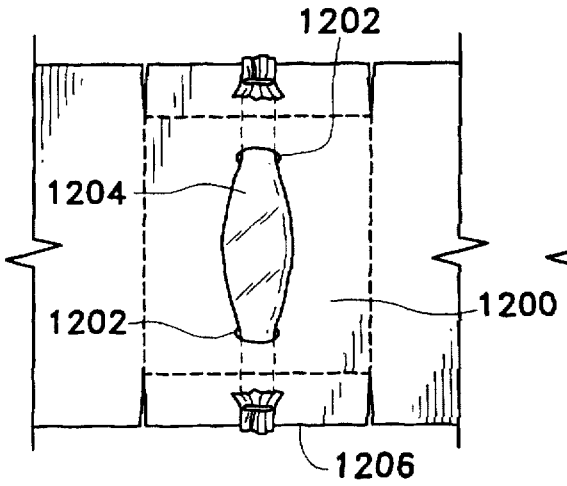
FIGS. 12 and 13 show partial plan views of support platforms useful in the inventive container.

FIG. 12 shows a support platform (1200) having a pair of orifices (1202) passing through the support platform (1200). The object to be protected is placed in sleeve or bag (1204). The ends of the bag are then inserted through the two orifices (1202) and secured either to the back of the support platform (1200) or to the edge of the platform (1206). The sleeve or bag (1204) containing the object may be stapled, glued, clipped or otherwise secured to the support platform (1200).

Figure 13:
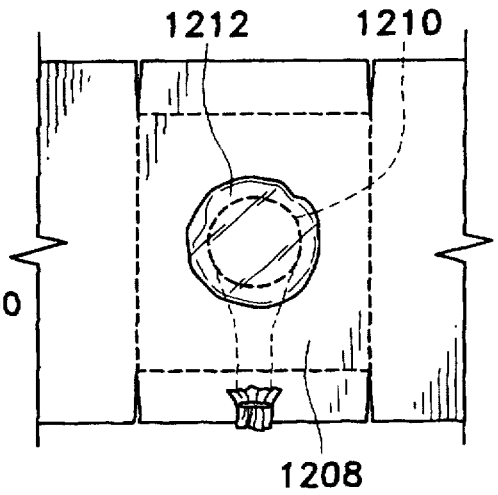

FIG. 13 shows a similar variation in which the support platform (1208) has but a single orifice (1210) and the bag (1212) used to contain the object to be protected is passed through the orifice and again secured either to the edge of support platform (1208) or to its underside.

The variations shown in FIGS. 12 and 13 may be modified by inclusion of extra orifices or multiple bags through the same set of orifices. Multiple bags are acceptable if a modest amount of contact between the two objects to be protected can be tolerated.

Figure 14A:
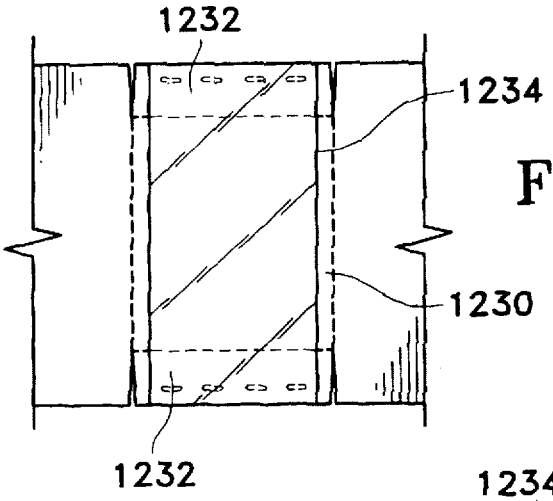
FIGS. 14A and 14B show, respectively, a partial plan view and a partial front quarter view of support platforms useful in the inventive container.
Figure 14B:
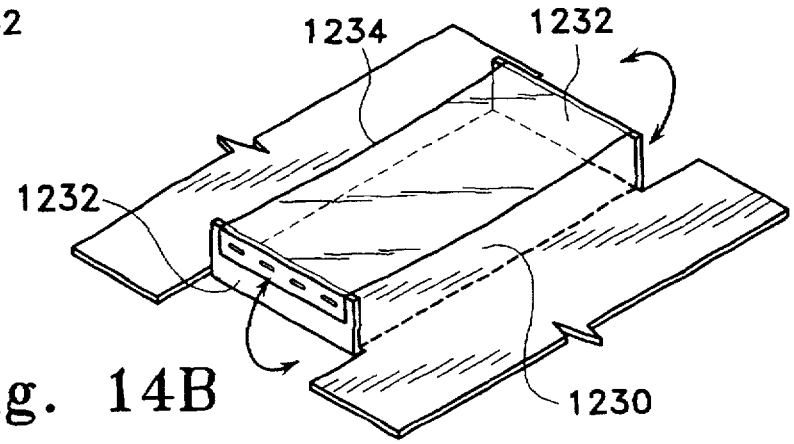

FIGS. 14A and 14B show support platform (1230) having two foldable flaps (1232) to which a sheet (1234) is attached.

FIG. 14A is a top view of the structure for holding an object in place. The object is placed beneath sheet (1234) by folding flaps (1232) upward as is shown in FIG. 14B. Folding flaps (1232) beneath support platform (1230) and stapling or otherwise affixing them there will maintain a constant pressure against the object placed under sheet (1232) and obviously hold it in place. An orifice may be placed in the center of support platform (1230) if additional positioning assistance is desired. It is preferred that sheet (1232) be polymeric or elastomeric or the like so that it stretches without breaking and without damaging the object to be protected.

Figure 15A:
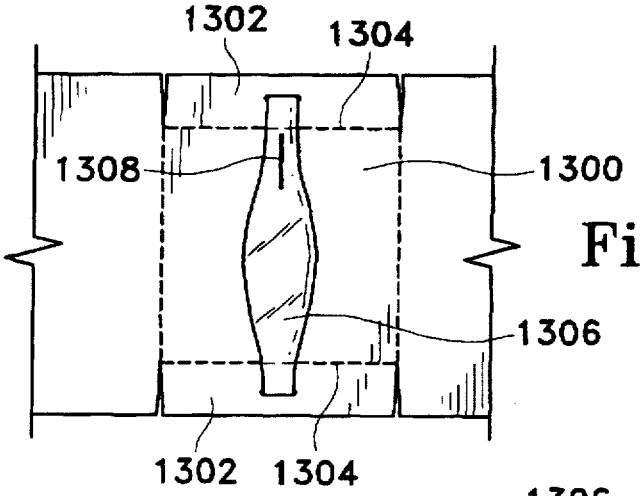
FIGS. 15A and 15B show, respectively, a partial plan view and a partial front quarter view of support platforms useful in the inventive container.
Figure 15B:
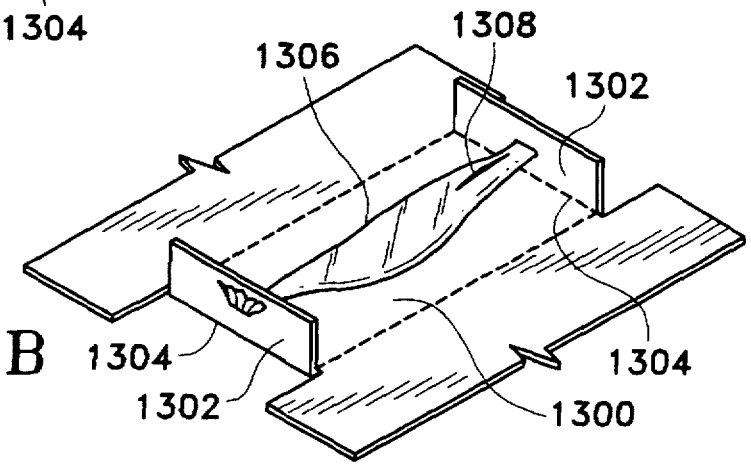

FIGS. 15A and 15B show a similar variation, again having a support platform (1300) with a pair of flaps (1302) which are rotatable about seam (1304). Attached to the flaps is a tubular member, preferably polymeric or elastomeric (1306) and having a slit or opening therein. When the flaps (1302) are rotated upwardly as is shown in FIG. 15B, the tubular member is loosened such that the object to be protected may be placed through the opening (1308). When flaps (1302) are rotated beneath the field of support member (1300), the object to be protected is held tightly against the center of support member (1300). Again, it would be good practice to cause flaps (1302) to adhere to the bottom of support platform (1300).

Figure 16:
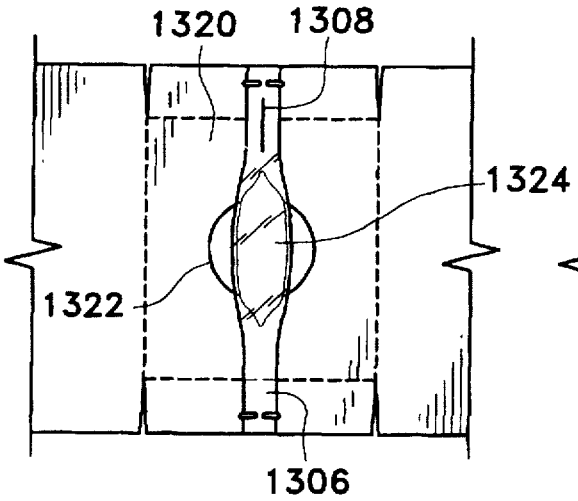
FIGS. 16 and 17 show, respectively, partial plan views of support platforms useful in the inventive container having orifices in the central platform.

FIG. 16 shows a plan view of one of the above variations in which the central field (1320) of the platform utilizes a very large orifice (1322). The large orifice (1322) allows the object to be protected (1324) to be suspended in the orifice using, e.g., the bag (1306) with the slit (1308) discussed above with respect to the variation shown in FIGS. 15A & 15B.

Figure 17:
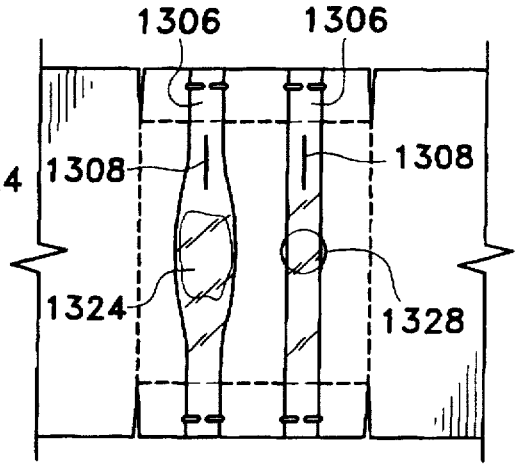

Finally, FIG. 17 shows a plan view of one of the above variations in which the central field (1320) of the platform utilizes a pair of orifices (1328). The orifices (1328) in this instance are smaller than the object to be protected (1324) and consequently the bag (1306) with the slit (1308) holds the object in place against the filed and, in particular, against the orifice (1328).

Other ways of maintaining the objects to be protected against the support platform would be apparent.

This invention has been described and specific examples of the invention have been portrayed. Use of those specifics is not intended to limit the invention in any way. Additionally, to the extent there are variations of the invention which are within the spirit of the disclosure and yet are equivalent to the invention found in the claims, it is our intent that this patent cover those variations as well.

I claim as my invention:

1. A protective container of:

a.) a foldable sheet which upon folding forms a protective container comprising i.) a plurality of container walls which upon said folding, form said protective container having an outer surface, an inner volume, inner surfaces defining said inner volume, and container wall fold lines adjacent said container walls and ii.) a support platform having edges at least two of which support platform edges are opposing, a support platform field spaced away from said support platform edges, and at least one edge foldably attached to a spacer panel, and iii.) said spacer panel foldably attached to at least one edge of said support platform wherein upon said folding, said spacer panel positions said two opposing edges of the support platform against said container walls and spaces the support platform field away from said containing walls, and wherein upon said folding said spacer panel extends to a container wall fold line, and b.) a retainer independent of and attached to said foldable sheet for retaining and positioning said at least one object with respect to said support platform field.

2. The protective container of claim 1 wherein the retainer positions said at least one object against said support platform field.

3. The protective container of claim 1 wherein the support platform field contains at least one orifice therethrough.

4. The protective container of claim 1 wherein the support platform has at least one edge foldably attached to a container wall.

5. The protective container of claim 1 wherein the spacer panel is foldably attached to a container wall.

6. The protective container of claim 5 wherein the support platform has at least one edge foldably attached to a container wall.

7. The protective container of claim 1 comprising exactly three container walls.

8. The protective container of claim 5 comprising exactly three container walls.

9. The protective container of claim 6 comprising exactly three container walls.

* * * * *